US010023344B2

(12) United States Patent
Austermeier et al.

(10) Patent No.: US 10,023,344 B2
(45) Date of Patent: Jul. 17, 2018

(54) LABELING OF FOLDED PRODUCTS

(71) Applicant: Multivac Marking & Inspection GmbH & Co. KG, Enger (DE)

(72) Inventors: Georg Austermeier, Hövelhof (DE); Uwe Mathews, Paderborn (DE)

(73) Assignee: Multivac Marketing & Inspection GmbH & Co. KG, Enger (DE)

( * ) Notice: Subject to any disclaimer, the term of this patent is extended or adjusted under 35 U.S.C. 154(b) by 210 days.

(21) Appl. No.: 14/875,344

(22) Filed: Oct. 5, 2015

(65) Prior Publication Data

US 2016/0096647 A1 Apr. 7, 2016

(30) Foreign Application Priority Data

Oct. 6, 2014 (EP) ..... 14187769

(51) Int. Cl.

| | |
|---|---|
| ***B65C 1/04*** | (2006.01) |
| ***B65C 9/36*** | (2006.01) |
| ***B65C 9/00*** | (2006.01) |

(52) U.S. Cl.

CPC ..... *B65C 9/36* (2013.01); *B65C 1/045* (2013.01); *B65C 9/0015* (2013.01)

(58) Field of Classification Search

None

See application file for complete search history.

(56) References Cited

U.S. PATENT DOCUMENTS

| | | | | |
|---|---|---|---|---|
| 4,160,687 | A | 7/1979 | Spear | |
| 5,209,808 | A | 5/1993 | Booth | |
| 5,635,017 | A | 6/1997 | Morrow | |
| 6,155,322 | A | 12/2000 | Landan et al. | |
| 8,474,503 | B2 * | 7/2013 | Kirk | B43M 5/04 156/441.5 |
| 2004/0038795 | A1 | 2/2004 | Jaksch | |

FOREIGN PATENT DOCUMENTS

EP 2657142 A1 10/2013

* cited by examiner

*Primary Examiner* — Barbara J Musser

(74) *Attorney, Agent, or Firm* — Husch Blackwell LLP

(57) ABSTRACT

The present invention relates to a labeler comprising a label dispenser used for applying an adhesive label to a folded product and a press-on device following the label dispenser in the conveying direction of a conveyor system. The press-on device comprises two press-on units, wherein one of the press-on units is reversibly drivable by means of a motor.

5 Claims, 8 Drawing Sheets

LABELING OF FOLDED PRODUCTS

CROSS-REFERENCE TO RELATED APPLICATIONS

This Application claims priority to European Patent Application Number 14187769.6 filed Oct. 6, 2014, to Georg Austermeier et al., currently pending, the entire disclosure of which is incorporated herein by reference.

FIELD OF THE INVENTION

The present invention relates to a labeler for labeling folded products.

BACKGROUND OF THE INVENTION

EP 2657142 A1 discloses a device for applying adhesive labels to the edges of folded products constituting the leading edges in the conveying direction. In the event that a folded product is to be labeled at its trailing edge, when seen in the production direction, EP 2657142 A1 provides a turning device turning the folded product by 180° before it arrives at the labeler, so that it can always be supplied to the labeler with the leading edges coming first, for applying an adhesive label at the leading side.

U.S. Pat. No. 4,160,687 discloses a labeler for applying, by means of sensor-controlled rotating brushes instead of blowing nozzles, adhesive labels to the folded product side constituting the trailing side in the direction of production for folding the label that was previously dispensed onto the upper side of the folded product also onto the bottom side, so as to replace blowing nozzles.

SUMMARY OF THE INVENTION

One object of the present invention is to provide an improved labeler for applying adhesive labels to folded products.

The labeler according to one embodiment of the present invention comprises a label dispenser for applying an adhesive label, referred to as label hereinbelow, to a folded product and a press-on device following the label dispenser in the conveying direction of a conveyor system. The press-on device can include two press-on units driven separately by a respective motor of their own, wherein one of the press-on units is reversibly drivable parallel to the conveying direction by means of a motor. This allows labels to be applied, in a continuous process, to folded products at the open side of the folded product independently of the orientation of this open side in the conveying direction or opposite thereto and without the necessity of providing a turning device for the folded products. It is not necessary to retool the labeler and the use of a compressed-air blowing unit, which is expensive to operate and offers little process reliability, can be dispensed with.

One of the press-on units may be arranged above and a further press-on unit maybe arranged below the conveyor system for the folded product, so as to fold a free end of the label to a position of vertical orientation in a first operating step and fold this free end of the label still further onto the folded product in a second operating step and press it against the folded product for protecting the open end of the latter against inadvertent unfolding, as is, for example, common practice with patient information leaflets for medications.

According to one embodiment, one of the press-on units comprises a spring-mounted press-on plate, so that differences in the height of the folded product or in the orientation of the folded product on the conveyor system can be compensated for, thus preventing damage to the label or the folded product during the folding process.

The press-on plate may be movable on a circular path so as to carry out two superimposed movements in the conveying direction and perpendicular thereto.

The circular path of the press-on plate can be realized by means of two disks, which may be synchronously driven in common and on which the press-on plate is supported by means of an adapter plate.

According to one embodiment, a sensor used for sensing the folded product or the position of the folded product is arranged upstream of the press-on device and the dispensing edge of the label dispenser when seen in the conveying direction. The sensor can here sense the position of the leading edge and/or of the trailing edge of the folded product and transmit this information to the control unit.

At least one of the press-on units, in particular the reversibly drivable press-on unit, preferably comprises a drive means, for example, a toothed belt or a chain, the drive means having provided thereon at least one press-on finger so as to carry out a folding operation and an operation of pressing-on the free end of the label.

The drivable press-on unit may comprise two drive wheels, one of the drive wheels being reversibly drivable by means of a motor drive so that the drive means itself can be moved reversibly, i.e., in a direction corresponding to the conveying direction in one mode of operation and opposite thereto in another mode of operation.

The method according to the present invention used for operating a labeler, which comprises a label dispenser for applying a label to a folded product and a press-on device including two press-on units, may be characterized in that one of the press-on units is reversibly driven by a motor so that folded products, which are either conveyed such that their open side is the leading side or in the reverse orientation, can be provided with an adhesive label without the necessity of retooling the labeler, which would lead to downtimes. "Reversibly driven" means that the labeler switches over between a first mode of operation in which the respective press-on unit, with its component entering into contact with the label, e.g., a press-on finger, moves in the same direction as the direction of movement of the folded products on the conveyor system, and a second mode of operation in which the respective press-on unit, with its component entering into contact with the label, stands still or moves in a direction opposite to the conveying direction of the folded products on the conveyor system. In each of the two modes of operation, the reversibly driven press-on unit presses the label onto one side of the folded product, when, after the dispensing of the label onto the folded product, the other press-on unit has turned down a projecting section of the label by preferably 90°.

In the first mode of operation, the component of the reversibly driven press-on unit pressing on the label preferably has or reaches a speed which exceeds the speed of the folded products themselves. In other words, the component pressing on the label can "overtake" the folded products while the folded products to be labeled are conveyed along the press-on units. Thus, it is primarily possible to press a label onto the folded product edge constituting the trailing edge when seen in the conveying direction.

One of the press-on units may comprise a spring-mounted press-on plate, which is moved on a circular path so as to fold a free end of the label that has already been dispensed onto the folded product.

According to one embodiment, the additional press-on unit folds, when the free end of the label has been folded to a position of approximately vertical orientation, the label further around the folded product by means of a press-on finger and presses the label then onto the folded product.

A control unit of the labeler can be configured for controlling a direction of rotation and the rotary speed of at least one of the press-on units depending on the conveying speed of the folded product and of the conveyor system, respectively, and the position of the label to be dispensed on the folded product. This leads to a process-reliable and positionally accurate application of the label around the open end of the folded product.

Other and further objects of the invention, together with the features of novelty appurtenant thereto, will appear in the course of the following description.

DESCRIPTION OF THE SEVERAL VIEWS OF THE DRAWING

In the following, an advantageous embodiment of the invention will be explained in more detail making reference to a drawing, in which the individual figures show.

Like components are provided with like reference numerals throughout the figures.

DETAILED DESCRIPTION OF THE INVENTION

Figure 1:
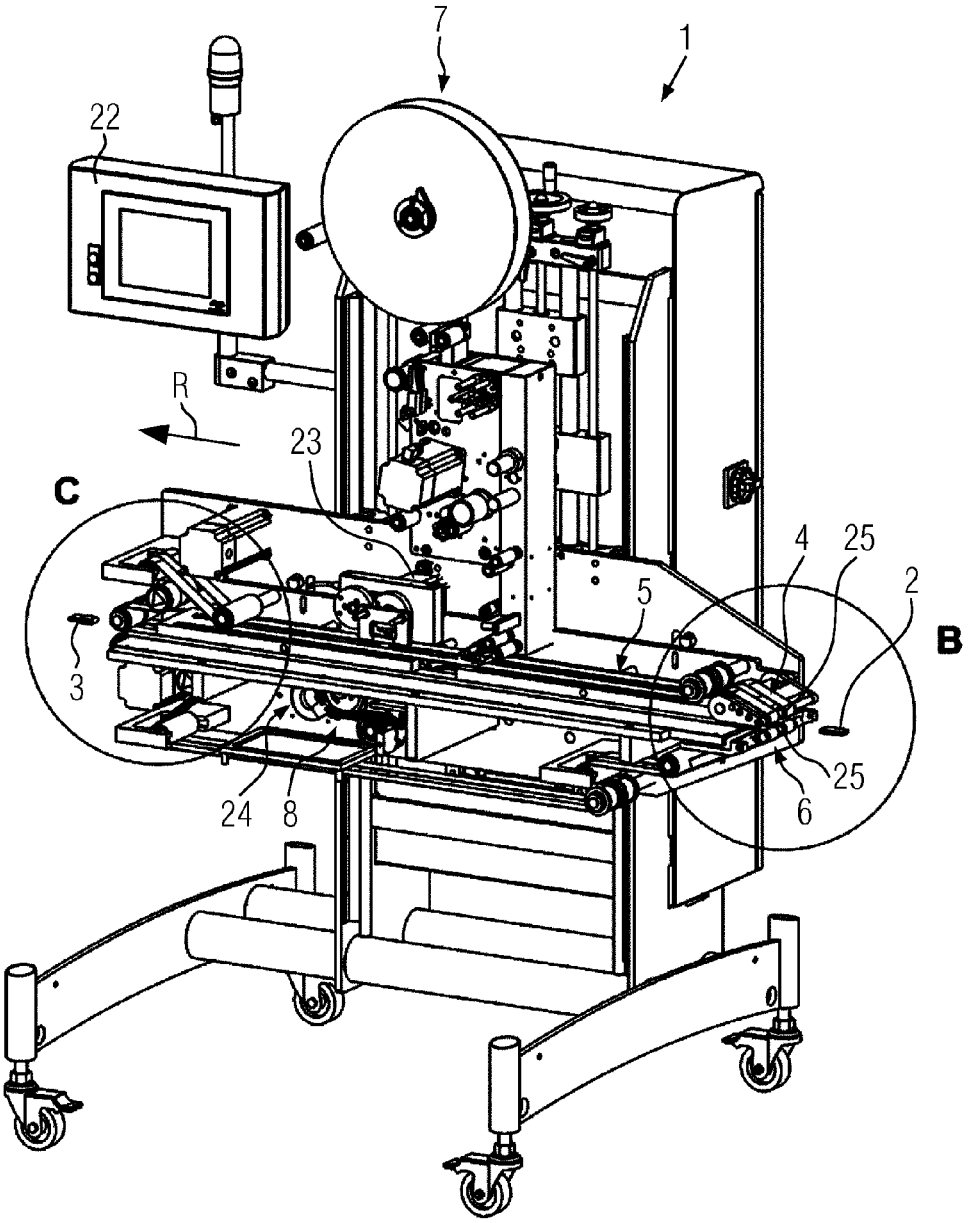
FIG. 1 is a side perspective view of a labeler in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a labeler 1 according to one embodiment of the present invention for providing folded products 2, like those provided as patient information leaflets for medications, with a label 3 on the open side thereof, so as to prevent undesired unfolding of the folded product 2. The folded product 2 is conveyed on a conveyor system 4 in a conveying direction R between upper and lower conveyor belts 5, 6. Each of the upper and lower conveyor belts 5, 6 may comprise an intermediate space 25 (see also FIG. 2), which is oriented transversely to the conveying direction and horizontally and through which the dispensed label 3 can extend. The labeler 1 can comprise a label dispenser 7 for dispensing a respective label 3 onto a leading or trailing end of the folded product 2. A press-on device 8 of the labeler 1 located downstream of the label dispenser 7 in the conveying direction R presses the respective end of the label 3, which projects freely to the front or to the rear, around the open side of the folded product 2 and onto the folded product 2 while the folded product 2 is being conveyed through the labeler 1 by means of the conveyor system 4.

Figure 2:
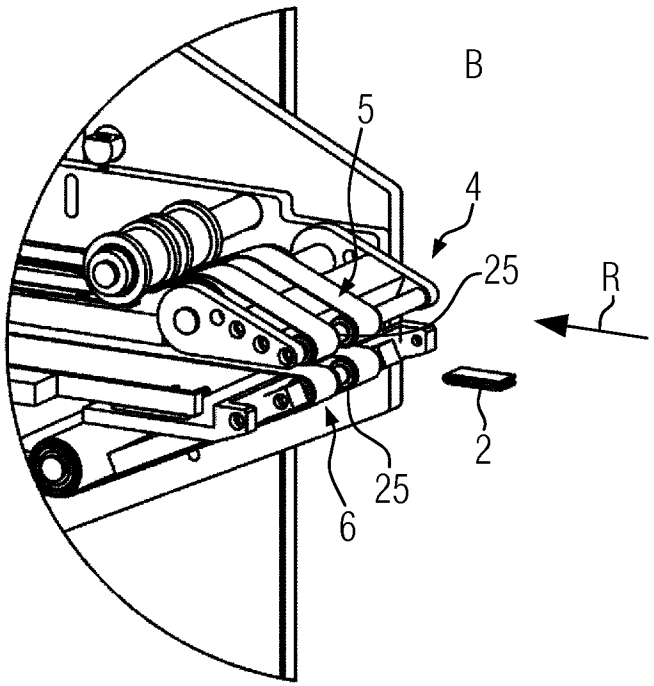
FIG. 2 is an enlarged side perspective view of a portion of an inlet of the labeler in balloon B of FIG. 1.

FIG. 2 shows an enlarged detail of the labeler 1 at the inlet. The folded product 2, which has its open side at its trailing side when seen in the conveying direction R, is fed to the conveyor system 4 by means of a conveying unit that is not shown in detail. The conveyor system 4 conveys the folded product 2 between the upper and lower conveyor belts 5, 6. An intermediate space 25 having at least the width of the label 3 can be provided between each pair of juxtaposed conveyor belts 5, 6.

Figure 3:
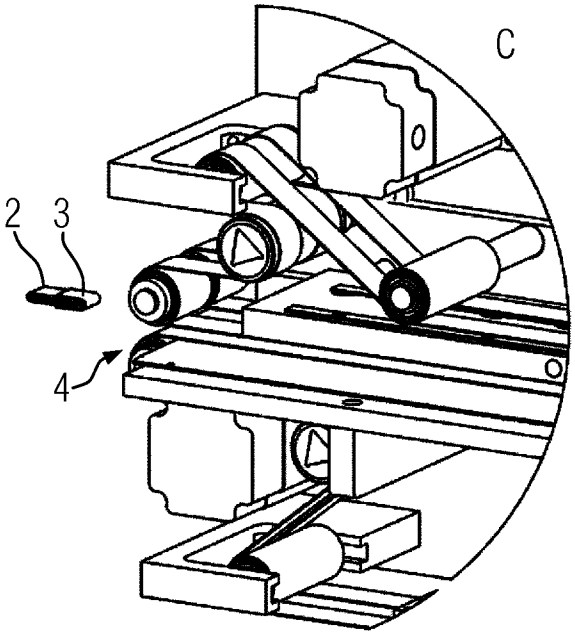
FIG. 3 is an enlarged side perspective view of a portion of an outlet of the labeler in balloon C of FIG. 1.

FIG. 3 shows an enlarged detail of the labeler 1 at the outlet with the folded product 2, which has had applied thereto a label 3 around the open side thereof. The folded product 2 provided with the label 3 may be transferred from the conveyor system 4 of the labeler 1 to a downstream conveying unit, which is not shown in detail, for supply to a cardboard box or a package, by way of example.

Figure 4:
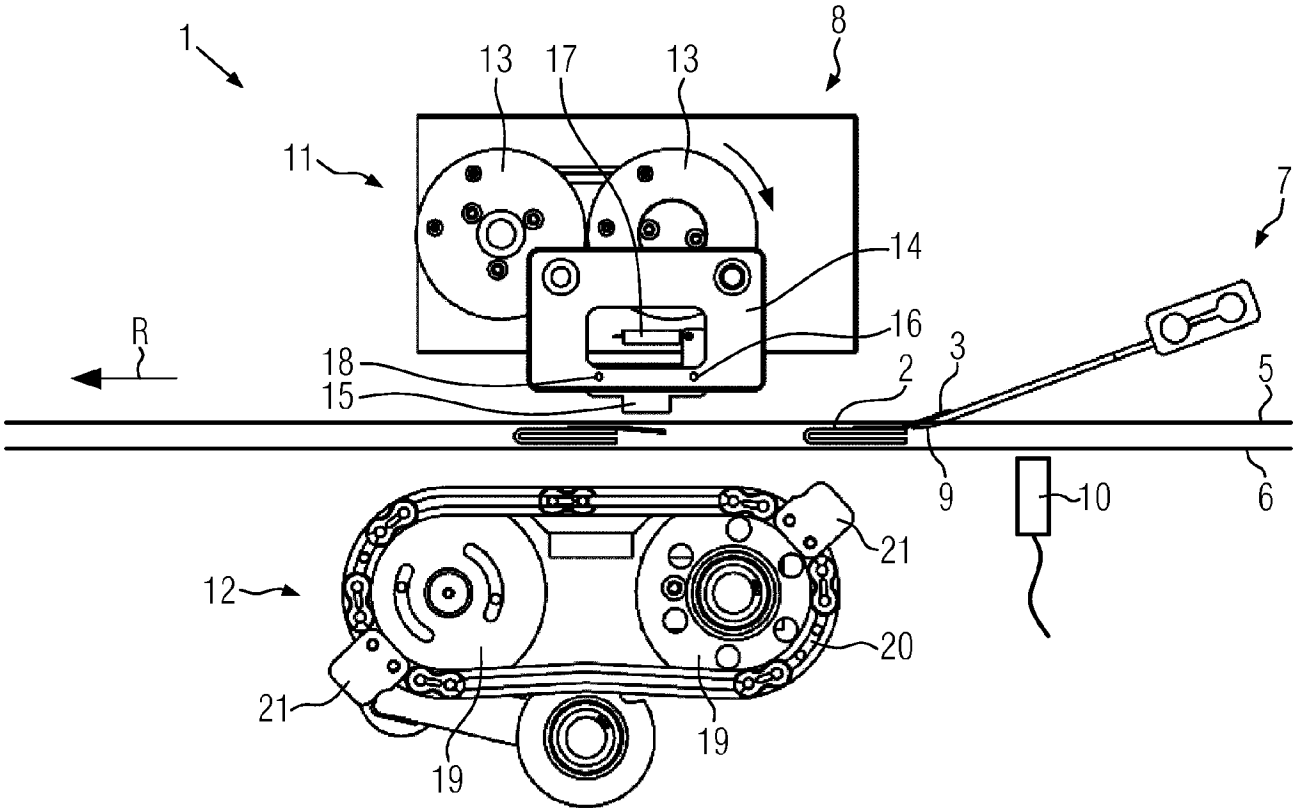
FIG. 4 is a schematic side view of a press-on device in a first phase with a label dispensed onto the trailing end of a folded product in accordance with one embodiment of the present invention.

FIG. 4 shows a detail of the labeler 1 in a side view with the press-on device 8 and a dispensing edge 9 of the label dispenser 7. The folded product 2 is conveyed in the conveying direction R from the right to the left by means of the lower and upper conveyor belts 5, 6 and, in the course of this process, it is sensed by a sensor 10, which may be configured as a photocell, a light barrier or the like. The sensor 10 transmits this information to a control unit 22 (see FIG. 1) of the labeler 1. This information may comprise the position of the leading edge and/or of the trailing edge of the folded product 2. The control unit 22 processes this information with the speed of the upper and lower conveyor belts 5, 6 so as to control the label dispenser 7 accordingly, so that the label 3 can be dispensed onto the folded product 2 at the desired position.

The folded product 2 with the label 3 dispensed thereonto may subsequently be supplied to the press-on device 8 in the conveying direction R. The label 3 has here a free end projecting forwards and beyond the open side of the folded product 2, the free end being folded and pressed-on by means of the press-on device 8. To this end, the press-on device 8 may have an upper press-on unit 11 and a lower press-on unit 12. The upper press-on unit 11 can comprise two synchronously rotating disks 13 having an adapter plate 14 arranged thereon such that the adapter plate 14 executes a circular movement, the orientation relative to the conveying direction R, i.e., parallel thereto, remaining unchanged during this movement. A press-on plate 15 is supported on the adapter plate 14 such that it is pivotable about an axis 16 oriented horizontally and transversely to the conveying direction R. Via a spring 17, the press-on plate 15 may be biased against a stop 18, the spring 17 having one of its sides connected to the adapter plate 14 and its other side connected to the press-on plate 15. The disks 13 can be driven via a motor 23, such as servomotor, shown in FIG. 1.

The lower press-on unit 12 may comprise two drive wheels 19, one of the drive wheels 19 being reversibly driven by means of a motor 24, such as a servomotor, shown in FIG. 1, i.e., the direction of rotation of the motor 24 and, consequently, of the drive wheel 19 can be reversed. A chain or belt 20 may extend around both drive wheels 19 and can be provided with two press-on fingers 21 acting on the label 3 and the folded product 2 in the intermediate space of the lower conveyor belts 6, i.e., the fingers define the component of the lower press-on unit 12 that enters into contact with the labels 3.

Making reference to the following FIGS. 4 to 9, the function of the press-on device 8 will now be explained in more detail.

Figure 5:
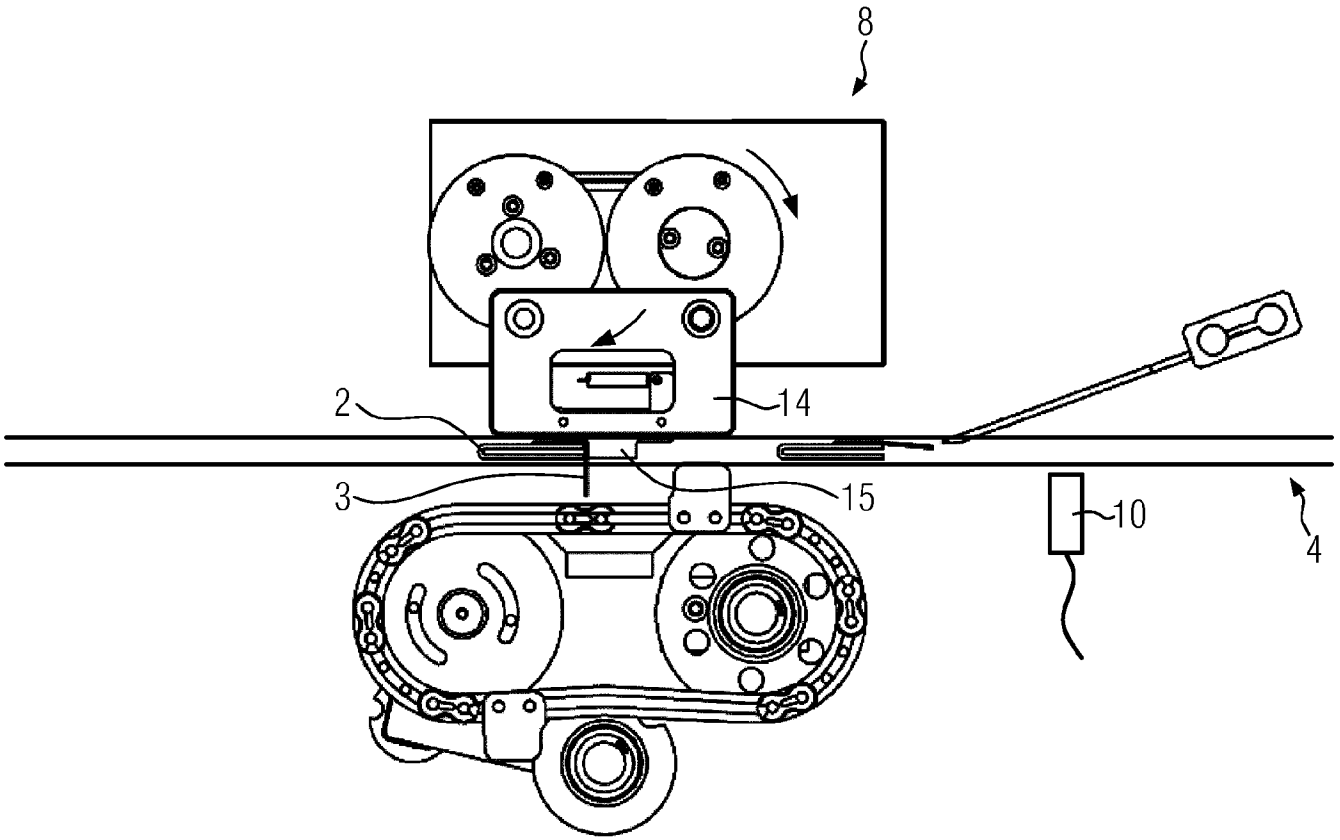
FIG. 5 is a schematic side view of a press-on device in a second phase with a turned-down label in accordance with one embodiment of the present invention.
Figure 6:
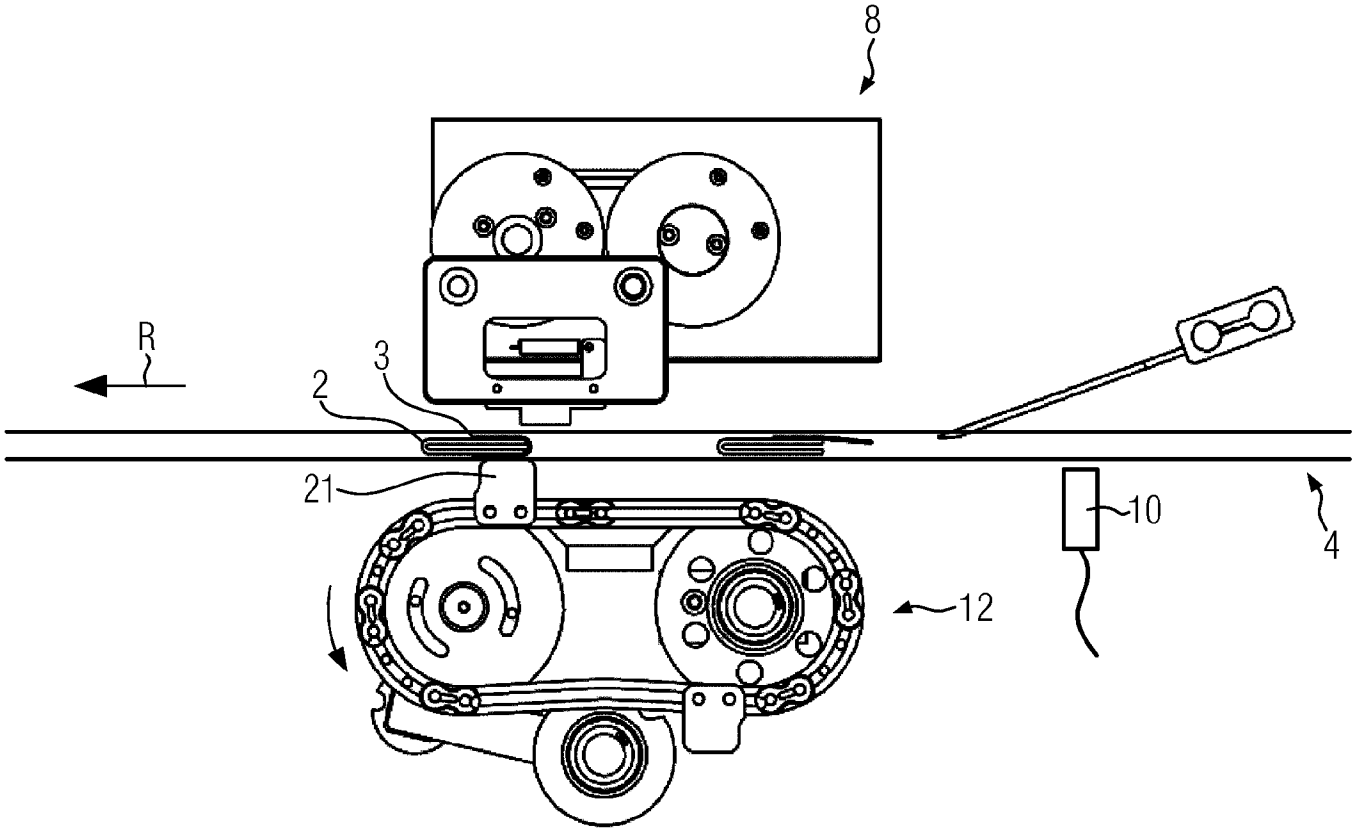
FIG. 6 is a schematic side view of a press-on device in a third phase in which the label has been pressed on in accordance with one embodiment of the present invention.

FIGS. 4 to 6 show how, in a first mode of operation of the labeler 1, the label 3 is dispensed onto the end of the folded product 2 constituting the trailing end when seen in the conveying direction R, the label 3 being dispensed onto the upper side of the folded product 2. The folded product 2 has its so-called open side at the trailing end, i.e., on the right-hand side as shown in the drawing, the open side being the side that is to be protected against inadvertent opening by means of the label 3. A short distance before the press-on device 8, the label 3 can be dispensed, at the dispensing edge 9 of the label dispenser 7, onto the upper side of the folded product 2 at the trailing end thereof, so that normally at least half of the label 3 will project beyond the folded product 2 in a direction opposite to the conveying direction R. As soon as the folded product 2 has moved to a position below the upper press-on unit 11, the latter may move the adapter plate 14 and, together therewith, the press-on plate 15 downwards into contact with the folded product 2 as well as in the conveying direction R, this superimposed movement being caused by the circular movement of the disks 13.

In the course of this process, the press-on plate 15 may force, as shown in FIG. 5, the free, projecting end of the label 3 downwards to a position of approximately vertical orientation. Different dimensions or different orientations of the folded product 2 on the conveyor system 4 can be compensated for by the press-on plate 15, which is spring-mounted in the adapter plate 14, and damage to the folded product 2 or the label 3 can be prevented in this way.

FIG. 6 shows how the press-on finger 21 of the lower press-on unit 12 moves then in the conveying direction R, the speed of the press-on finger 21 exceeding the speed of the folded product 2 and of the conveyor system 4, respectively. Hence, the press-on finger 21 causes the free end of the label 3 to be folded or turned still further onto the bottom side of the folded product 2 and to be pressed against the bottom side of the folded product 2 during the common, non-synchronous movement towards the end of the press-on device 8.

Figure 7:
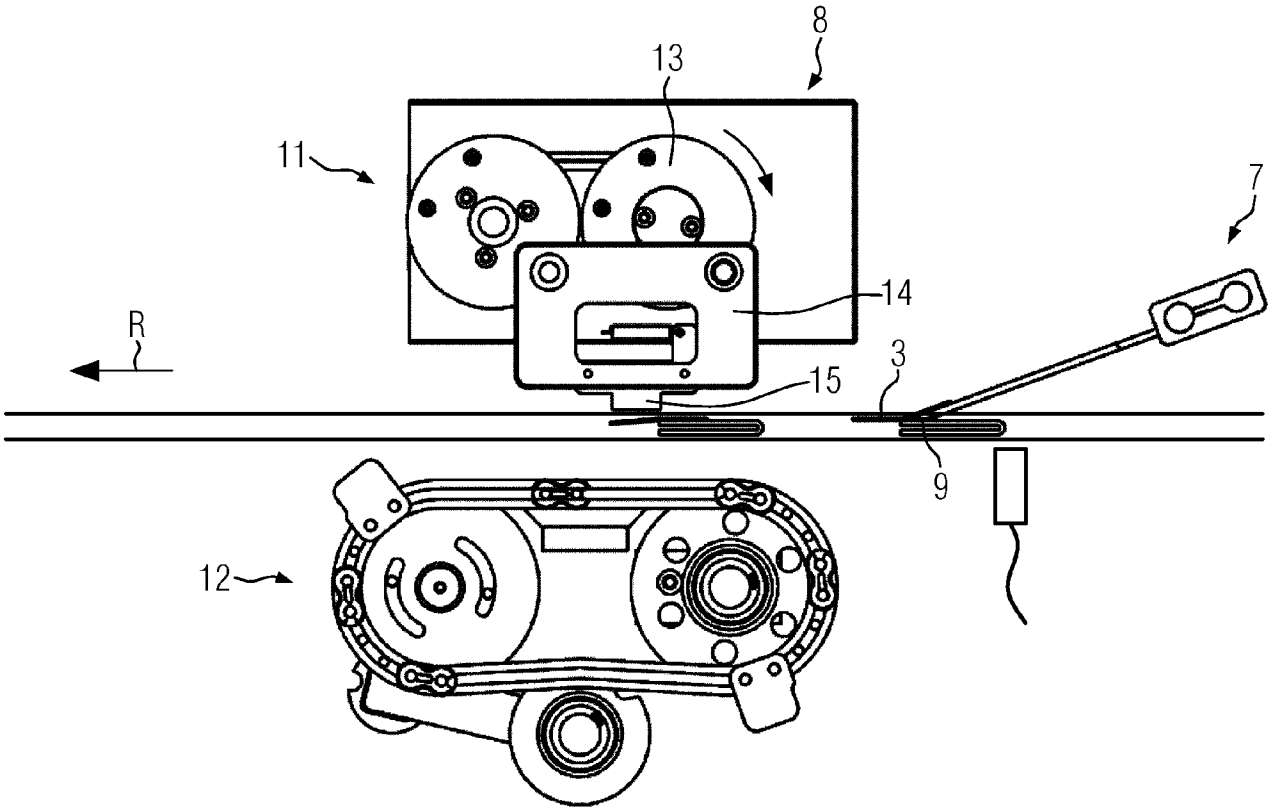
FIG. 7 is a schematic side view of a press-on device in a first phase with a label dispensed onto the leading end of a folded product in accordance with one embodiment of the present invention.
Figure 8:
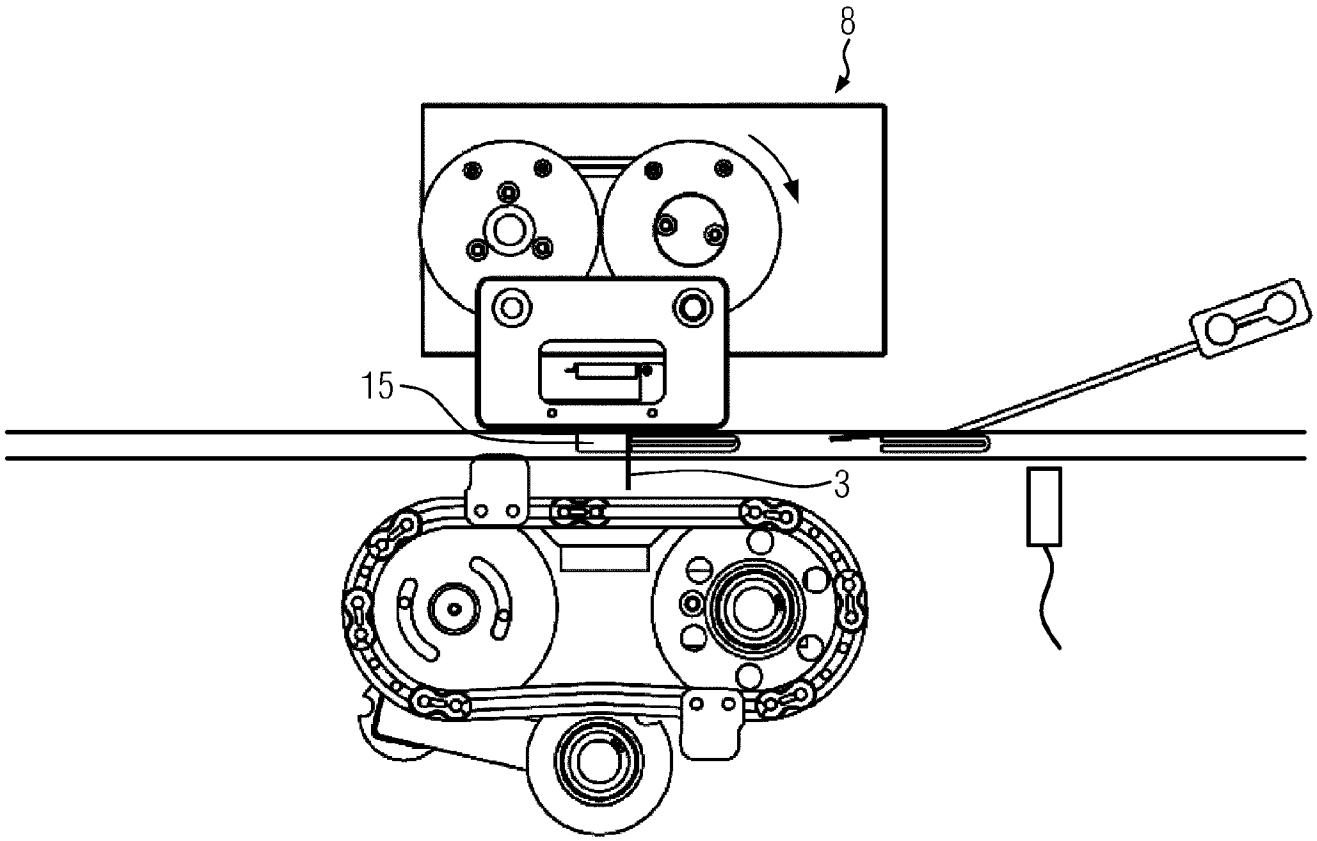
FIG. 8 is a schematic side view of a press-on device in a second phase with a turned-down label in accordance with one embodiment of the present invention.
Figure 9:
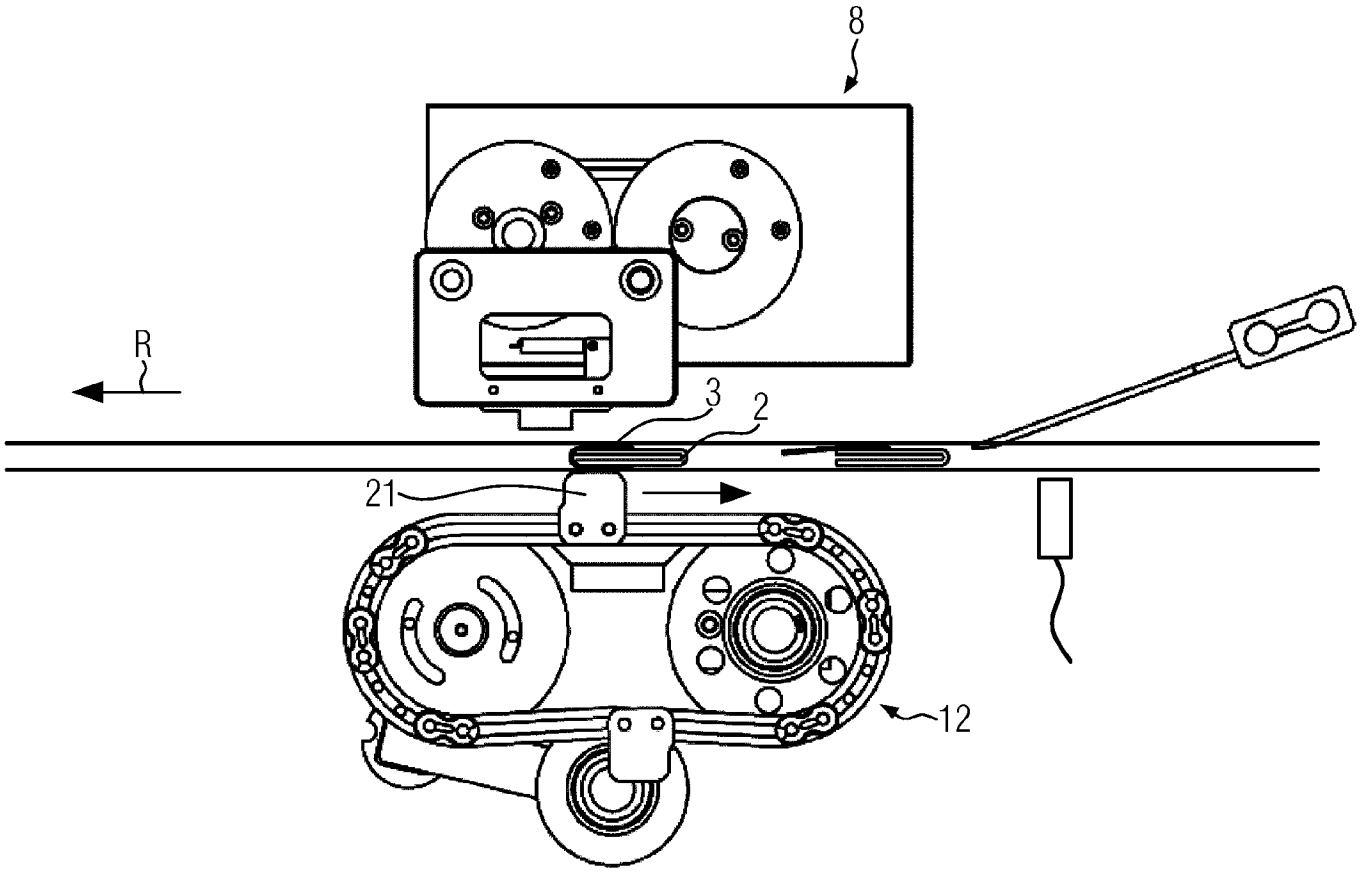
FIG. 9 is a schematic side view of a press-on device in a third phase in which the label has been pressed on in accordance with one embodiment of the present invention.

FIGS. 7 to 9 show how, in a second mode of operation of the labeler 1, the label 3 is dispensed onto the end of the folded product 2 constituting the leading end when seen in the conveying direction R, the label 3 being dispensed onto the upper side of the folded product 2. As shown in FIG. 7, the folded product 2 now has its so-called open side at the leading end, i.e., on the left-hand side as shown in the drawing, the open side being the side that is to be protected by the label 3. A short distance before the press-on device 8, the label 3 is dispensed, by the dispensing edge 9 of the label dispenser 7, onto the upper side of the folded product 2 at the leading end thereof, so that normally at least half of the label 3 will project beyond the folded product 2 in the conveying direction R. As soon as the folded product 2 has moved to a position below the upper press-on unit 11, the adapter plate 14 and, together therewith, the press-on plate 15 can move downwardly into contact with the folded product 2 as well as in the conveying direction R, this superimposed movement being caused by the circular movement of the disks 13.

FIG. 8 shows how the press-on plate 15 folds the free, projecting end of the label 3 downwardly to a position of approximately vertical orientation.

As shown in FIG. 9, the press-on finger 21 of the lower press-on unit 12 is moved in a direction opposite to the conveying direction R to a position at which, due to the opposite relative movement between the folded product 2 and the press-on finger 21, the press-on finger 21 presses the free end of the label 3, which extends vertically downwards, against the bottom side of the folded product 2 and folds it thereonto. The press-on finger 21 may stand still at this position or it may carry out a continuous movement in a direction opposite to the conveying direction R.

The present invention also comprises an alternative embodiment, in the case of which the label 3 is dispensed from below onto the folded product 2 and the upper and lower press-on units 11, 12 are provided in an exchanged mode of arrangement for this purpose. Likewise, an arrangement is imaginable, in the case of which the folded product is conveyed not in a horizontal but in an upright position and the press-on units 11, 12 are therefore arranged laterally of the conveyor system 4.

The control unit 22 may be provided as a common control unit for the conveyor system 4, the label dispenser 7 and the press-on device 8. If necessary, the control unit 22 may switch over the labeler 1 between the two different modes of operation in response to a respective user input, or, making use of programs or recipes stored in the control unit 22, the labeler 1 may automatically be adjusted or switched over to the mode of operation stored in the program or recipe.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A method of operating a labeler that includes a label dispenser with a press-on device having a first press-on unit and a second press-on unit, said first press-on unit driven by a first motor and said second press-on unit driven by a second motor, and further including a conveyor system for conveying folded products to be labeled in a conveying direction, the method comprising the steps of:

dispensing a label onto a folded product using the label dispenser;

operating the labeler in one of a first mode of operation or a second mode of operation after the label has been dispensed;

wherein said first mode of operation comprises the steps of: folding a first section of the label that projects beyond the folded product using the first press-on unit; folding a second section of the label that still projects beyond the folded product after the folding the first section step still further; and pressing the second section of the label onto the folded product using a component of the second press-on unit, wherein the component moves in the conveying direction; and wherein said second mode of operation comprises the steps of: folding the first section of the label that projects beyond the folded product using the first press-on unit; folding the second section of the label that still projects beyond the folded product after the first folding step still further; and pressing the second section of the label onto the folded product using the component of the second press-on unit, wherein the component stands still or moves in a direction opposite to the conveying direction; and moving a press-on plate of one of the first press-on unit or the second press-on unit in a circular path to fold a free end of the label after the label has been dispensed onto the folded product.

2. A method of operating a labeler that includes a label dispenser with a press-on device having a first press-on unit and a second press-on unit, said first press-on unit driven by a first motor and said second press-on unit driven by a second motor, and further including a conveyor system for conveying folded products to be labeled in a conveying direction, the method comprising the steps of:

dispensing a label onto a folded product using the label dispenser;

operating the labeler in one of a first mode of operation or a second mode of operation after the label has been dispensed;

wherein said first mode of operation comprises the steps of folding a first section of the label that projects beyond the folded product using the first press-on unit; folding a second section of the label that still projects beyond the folded product after the folding the first section step still further, and pressing the second section of the label onto the folded product using a component of the second press-on unit moving in a direction corresponding to the conveying direction; and wherein said second mode of operation comprises the steps of folding the first section of the label that projects beyond the folded product using the first press-on unit; folding the second section of the label that still projects beyond the folded product after the folding the first section step still further; and pressing the second section of the label onto the folded product using the component of the second press-on unit, wherein the component either stands still or moves in a direction opposite to the conveying direction; and moving a spring-mounted press-on plate of one of the first press-on unit or the second press-on unit in a circular path to fold a free end of the label after the label has been dispensed onto the folded product.

3. The method according to claim 2, wherein the first mode of operation further comprises moving the component of the second press-on unit in the conveying direction at a speed exceeding a speed of the folded product on the conveyor system.

4. The method according to claim 2, further comprising the step of folding the label still further on the folded product using a press-on finger disposed on the second press-on unit and pressing the label onto the product when the free end of the label has been folded by the first press-on unit to a position of approximately vertical orientation.

5. The method according to claim 2, further comprising the step of controlling a direction of rotation and a rotary speed of one of the first or second press-on units with a control unit of the labeler depending on (a) a conveying speed of the folded product or of a conveyor system and (b) a position of the label to be dispensed on the folded product.

* * * * *